US006190010B1

(12) United States Patent
Tanaka

(10) Patent No.: US 6,190,010 B1
(45) Date of Patent: Feb. 20, 2001

(54) CARRIAGE FOR INK CARTRIDGE AND PRINTHEAD FOR INK-JET PRINTER

(75) Inventor: Toru Tanaka, Miigata (JP)

(73) Assignee: NEC Corporation, Tokyo (JP)

( * ) Notice: Under 35 U.S.C. 154(b), the term of this patent shall be extended for 0 days.

(21) Appl. No.: 08/985,234

(22) Filed: Dec. 4, 1997

(30) Foreign Application Priority Data

Dec. 4, 1996 (JP) ..... 8-323662

(51) Int. Cl.[7] ..... B41J 29/13
(52) U.S. Cl. ..... 347/108
(58) Field of Search ..... 347/29, 37, 49, 347/108, 138, 86; 206/204

(56) References Cited

U.S. PATENT DOCUMENTS

| | | | | |
|---|---|---|---|---|
| 5,373,936 | * | 12/1994 | Kawai et al. | 206/204 |
| 5,504,513 | | 4/1996 | Nobel et al. | 347/87 |
| 5,654,744 | | 8/1997 | Nicoloff et al. | 347/43 |
| 5,663,751 | | 9/1997 | Holbrook | 347/22 |
| 5,805,181 | * | 9/1998 | Tanaka et al. | 347/29 |

FOREIGN PATENT DOCUMENTS

| | | |
|---|---|---|
| 297 11 899 | 10/1997 | (DE) . |
| 0 710 568 | 5/1996 | (EP) . |
| 0 824 074 | 2/1998 | (EP) . |
| 2 298 822 | 9/1996 | (GB) . |
| 51-20802 | 7/1974 | (JP) . |
| 57-125580 | 1/1981 | (JP) . |
| 2-178051 | 7/1990 | (JP) . |
| 6-106730 | 4/1994 | (JP) . |
| 7-68777 | 3/1995 | (JP) . |
| 7-503219 | 4/1995 | (JP) . |
| 7-246716 | 9/1995 | (JP) . |
| 8-187875 | 7/1996 | (JP) . |
| 8-258277 | 10/1996 | (JP) . |

OTHER PUBLICATIONS

Patent Abstracts of Japan, vol. 018, No. 383 (M–1640), Jul. 19, 1994.
Patent Abstracts of Japan, vol. 96, No. 001, Jan. 31, 1996.

* cited by examiner

*Primary Examiner*—N. Le
*Assistant Examiner*—Anh T. N. Vo
(74) *Attorney, Agent, or Firm*—Sughrue, Mion, Zinn, Macpeak & Seas, PLLC

(57) ABSTRACT

A carriage for housing an ink cartridge as a source of supply of ink to an ink-jet printhead for an ink-jet printer comprises a snap hook for locking engagement with a lock lever that is pivotally supported by a case. The hook includes a cantilever fixed at one end to a sidewall of the case and a head for engagement with the lock lever. The cantilever is elastically inclined by said lock lever and allowed to snap back toward its unstressed state to put the head into a window of the lock lever into frictional engagement with a predetermined surface of a knob of the lock lever. For releasing this engagement, manually pressing the cantilever to incline the cantilever causes the head to move the knob until the window comes into registry with the head.

18 Claims, 4 Drawing Sheets

CARRIAGE FOR INK CARTRIDGE AND PRINTHEAD FOR INK-JET PRINTER

BACKGROUND OF THE INVENTION

1. Field of the Invention

The present invention relates to ink-jet printers and, more particularly to a carriage for an ink cartridge as a source of supply of ink to an ink-jet printhead.

2. Description of the Related Art

Ink-jet printers print by shooting drops of ink onto a page. The ink is stored in an ink cartridge and discharged onto the page through an ink-jet printhead. The ink cartridge and printhead are housed in a carriage that can move reciprocally across the page. To print an image, the printhead moves back and Forth across the page shooting drops as it moves.

JP-A7-246716 discloses an ink-jet printer wherein an ink cartridge and an ink-jet printhead are housed in a carriage. The cartridge has a rack. The carriage includes a base, a case fixed to the base, a pinion lever and a lock lever. The base supports the printhead. The lock lever and the pinion lever are pivoted to a pivot support that is fixedly attached to the case. At one end portion, the lock lever has a lock lever axis that is disposed in the neighborhood of an upper edge of the case At the opposite end portion, the lock lever has a knob including a hook adapted to engage a predetermined portion of the upper edge of the case. At an intermediate portion between the lock lever axis and the knob, the lock lever is formed with a protrusion adapted to contact with a top face of the cartridge. The pinion lever includes a pinion. The pinion has a pinion axis, about which the pinion lever pivots. The pinion axis is so arranged as to cause the pinion to engage the rack upon insertion of the cartridge into the case. The pinion lever has a pin cooperating with a groove of the lock lever for conjoint operation therewith. A spring biases the pinion lever in such a direction as to separate the pin from the groove of the lock lever, causing the pinion to lift the cartridge towards an elevated position from the upper edge of the case. Replacement of an old cartridge with a new one is initiated by manipulating the knob to disengage the hook from the upper edge of the case and turning the lock lever in an unlocking direction about the axis. This causes the pinion lever to turn the pinion to lift the cartridge to the elevated position. In this elevated position, the old cartridge is removed easily from the case for replacement with a new one. The new cartridge is inserted into the case with its rack engaging the pinion and held in the elevated position due to the spring of the pinion lever. Then, the lock lever is turned in a locking direction, opposite to the unlocking direction, causing the protrusion to lower the cartridge against the spring to an operative position. This turning motion of the lock lever in the locking direction is completed upon engagement of the hook with the upper edge of the case.

FIG. 4 illustrates in section a less preferred example of a carriage, generally designated by the reference numeral 1, of an ink-jet printer. The carriage 1 houses an ink-jet printhead 2 and an ink cartridge 3. A guide rod 7 supports the carriage 1 for reciprocal back and forth motion across a page. A lock lever 4 is provided to lock the cartridge 3 to an operative position within the carriage 1. At one end portion, the lock lever 4 is pivotally supported via a rotary shaft 4*a* by a shaft-supporting portion 1*a* of the carriage 1. At the opposite end portion, the lock lever 4 is provided with a downwardly extending knob 4*b*. At a leading end portion, the knob 4*b* is curled inwardly to define a hook 4*c*. The hook 4*c* is elastic enough to engage, in a snap fit manner, a lateral projection on a sidewall of the carriage 1. At an intermediate portion between the one and the opposite end portion, the lock lever 4 is formed with a protrusion 4*d*. In FIG. 4, the fully drawn line shows the lock lever 4 in a position to close an opening of the carriage 1. In this position, the protrusion 4*d* presses the cartridge 3 on a top face thereof into a locked state. At a bottom face, the cartridge 3 is provided with an ink supply port 5. At a position opposed to the ink supply port 5, an elastic cap 6 is arranged on the printhead 2.

Replacement of cartridge with a new one is initiated by manipulating the knob 4*b* to disengage the hook 4*c* from the lateral projection 1*b* of the carriage 1 and turning the lock lever in an unlocking direction, clockwise viewing in FIG. 4, about the axis of the rotary shaft 4*a*. This uncovers the cartridge 3, allowing replacement with a new one. The new cartridge is inserted into the carriage 1. Then, the lock lever 4 is turned in a locking direction, opposite to the unlocking direction, causing the protrusion 4*d* to lower the cartridge 3, compressing the elastic cap 6, to an operative position. This turning motion of the lock lever 4 in the locking direction is completed upon frictional engagement of the hook 4*b* with the lateral projection 1*b* of the carriage 1.

The elastic cap 6 is compressed to firmly engage the bottom face of the cartridge 3 to define and seal a cavity around the ink supply port 5. The reaction force of the compression of the elastic cap 6 acts on the lock lever 4 via the interface between the top face of the cartridge 3 and the protrusion 4*d*. As the hook 4*c* and the rotary shaft 4*a* engage the edge 1*b* and the shaft-supporting portion 1*a*, respectively, the edge 1*b* and the shaft-supporting portion 1*a* bear all stress that the lock lever 4 is subjected to. At the interface between the hook 4*b* and the edge 1*b* of the carriage 1, a component of the reaction force acts on the edge 1*b* in a direction normal thereto, producing resistance to be overcome in disengaging the hook 4*c* from the lateral projection 1*b*. A problem with structure is that if the elastic cap 6 is compressed sufficiently to provide an effective seal around the ink supply port 5, effort required to disengage the hook 4*b* from the edge 1*b* may increase to an unacceptably high level.

An object of the present invention is to provide a carriage for an ink cartridge as a source of supply of ink to an ink-jet printhead for an ink-jet printer, wherein a lock lever applies a sufficiently large force to the ink cartridge with less effort required for releasing the lock lever.

SUMMARY OF THE INVENTION

According to one aspect of the present invention, there is provided a carriage for an ink cartridge as a source of supply of ink to an ink-jet printhead for an ink-jet printer, comprising:

- a case for the ink cartridge
- a lock lever having one end portion pivoted to said case and an opposite end portion; and
- a snap hook fixed to said case for engagement with said lock lever at said opposite end portion.

DESCRIPTION OF THE EMBODIMENT

Figure 1:
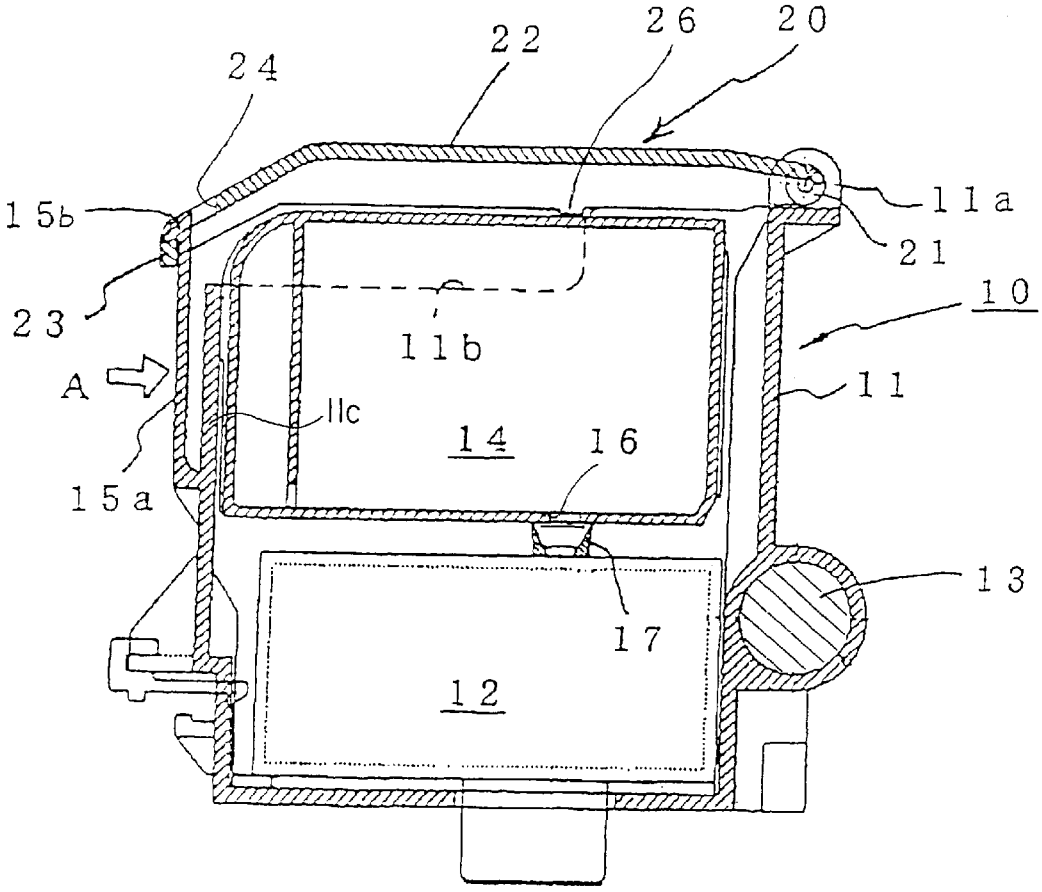
FIG. 1 is a fragmentary cross section of an ink-jet printer showing a carriage incorporating the present invention.

FIG. 1 shows a portion of a typical ink-jet printer sectioned 50 that a carriage 10 is visible. The carriage 10 includes a case 11. An ink-jet printhead 12 is mounted to a bottom of the case 11. A guide rod 13 extends across a page and guides the carriage 10 so that the printhead 12 moves back and forth on the rod 13 shooting drops of ink as it moves. The carriage is 10 supports within the case 11 an ink cartridge 14 that contains ink to be supplied to the ink-jet printhead 12. The carriage 10 includes a lock lever 20. The lock lever 20 is provided to lock the ink cartridge 14 in a predetermined operative position as illustrated in FIG. 1 within the case 11.

Figure 2:
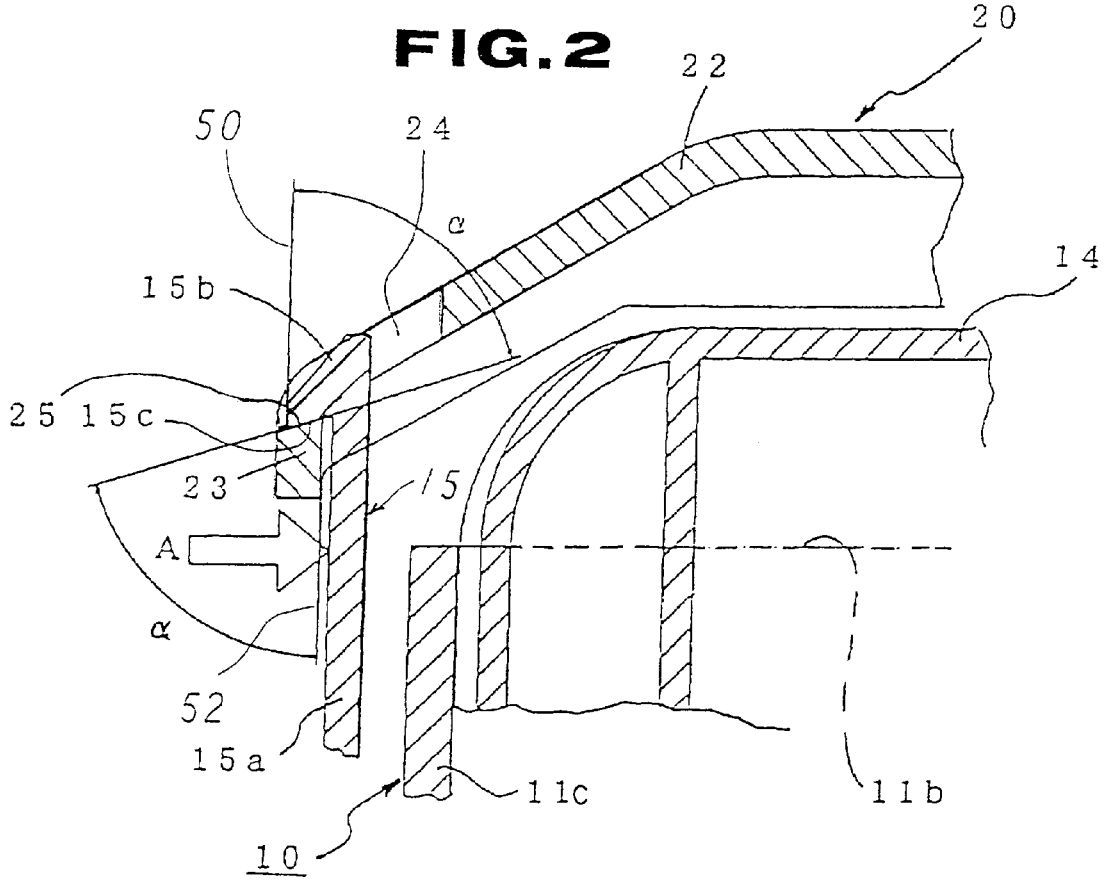
FIG. 2 is a fragmentary magnified view of the carriage shown in FIG. 1.

At one or right, viewing in FIG. 1, end portion, the lock lever 20 is pivotally supported via a rotary shaft 21 by a shaft-supporting portion 11*a* of the case 11. The lock lever 20 includes a cover plate 22. The cover plate 22 defines the outer periphery of the lock lever 20 and extends from the one to the opposite end of thereof. At the opposite or left, viewing in FIG. 1, end portion, the lock lever 20 has a knob 23 that is formed with a predetermined surface 25 as best seen in FIG. 2. At an intermediate portion between the one and the opposite end portion, the lock lever 20 is formed with a protrusion 26. In FIG. 2, the fully drawn line shows the lock lever 20 in a position to close an opening 11*b* for insertion of the cartridge 14. In this position, the protrusion 26 presses the cartridge 14 on a top face thereof into a locked state. At a bottom face, the cartridge 14 is provided with an ink supply port 16. At a position opposed to the ink supply port 16, an elastic cap 17 of elastic material such as rubber is arranged on the printhead 12.

Viewing in FIG. 2, the cover plate 22 Is curled at the opposite end portion downwardly to define the knob 23 and recessed or cut inwards from the inner surface thereof to define the predetermined surface 25. In this embodiment, the cover plate 22 is formed with an opening or window 24. If desired, the cover plate 22 may be formed with a recess instead of the window 24. The window 24 is so dimensioned as to allow insertion of a pawl-like head 15*b* of a snap hook 15 during the final stage of pivotal movement of the lock lever 20 from an opened position of FIG. 3 to a closed or locked position of FIG. 1. The locked position is defined by engagement of the predetermined surface 25 of the knob 23 with a mating surface 15*c* of the head 15*b*. The hook 15 includes a cantilever 15*a*. The cantilever 15*a* is provided to hold the head 15*b*. The cantilever 15*a* is elastically inclined and allowed to snap back toward its unstressed position to put the head 15*b* into the window 24 during the final stage of movement of the lock lever 20 towards the position of FIG. 1. To release the lock lever 20 from the locked position of FIG. 1, the cantilever 15*a* is inclined manually to cause the head 15*b* to move the knob 23 until the window 24 comes into registry with the head 15*b*. At the downwardly curled portion, the lock lever 20 is elastically bent to allow such movement of the knob 23. The cantilever 15*a* is supported at one end by the case 11 of the carriage 10 and holds the head 15*b* at the opposite end. In its unstressed position, the cantilever 15*a* extends in a spaced relation with a sidewall 11*c* of the case 11. In this embodiment, the hook 15 is made of a plastic material and the head 15*b* is an integral part of and defines the opposite end of the cantilever 15*a*. The cantilever 15*a* elastically inclines upon application of a force toward the sidewall 11*c* in one direction to move the head 15*b* toward the sidewall 11*c*. Subsequently, eliminating the force allows the cantilever 15*a* to snap back toward its unstressed position to move the head 15*b* back to its original position.

Viewing in FIG. 2, let it be assumed that there is drawn a circle about the axis of the rotary shaft 21 intersecting the predetermined surface 25 of the knob 23 at a predetermined point between one and opposite limits of the surface 25. Then, it may be described that the predetermined surface 25 of the knob 23 is inclined with respect to a reference line segment 50 that is tangential to the circle and extends outwardly from the predetermined point of the surface 25. The surface 25 is inclined from the position on the reference line segment 50 through an acute angle $\alpha$ (alpha). The inclined surface 25 faces outwardly as viewed from the axis of the rotary shaft 21 and has leading and trailing limit with respect to a direction of pivotal movement of the lock lever 20 from the position of FIG. 1 to, the position of FIG. 3. The leading limit is disposed less distant from the axis of the rotary shaft 21 than the trailing limit is. In the position as illustrated in FIG. 2, the mating surface 15*c* of the head 15*b* is inclined by an acute angle with respect to a line segment 52 that is parallel to the reference line segment 50 and extends outwardly from the mating surface 15*c*. In this embodiment, the angle of this inclination is the same as the angle $\alpha$ (alpha) to accomplish a close fitting although the former may differ from the latter as long as deviation from the close fitting is acceptable.

As illustrated in FIG. 2, the angle $\alpha$ (alpha) is approximately 75 degrees in this embodiment.

Upon mounting the ink cartridge 14 within the carriage 10, the cartridge 14 is inserted into the carriage 10 through the opening 11*b* and then the lock lever 20 is pressed toward the case 11 after its counterclockwise rotation about the rotary shaft 21. In the process, the protrusion 26 is pressed against the top face of the cartridge 14 The force to which the cartridge 14 is subjected range from 100 g to 2 kg if expressed in terms of a weight which the cartridge 14 supports. Under this condition, the elastic cap 17 is elastically deformed or compressed to effectively seal a cavity around the ink supply port 16. During the final stage of movement of the lock lever 20 toward the position of FIG. 1 or 2, the inner surface of the knob 23 comes into pressing contact with the head 15*b* to incline the cantilever 15*a* until the window 24 comes into registry with the head 15*b*. The cantilever 15*a* is allowed to snap back toward its unstressed position to put the head 15*b* into the window 24 to bring the surface 15*c* into engagement with the surface 25 of the knob 23.

In the position of FIG. 1, the reaction due to the compression of the elastic cap 17 acts through the cartridge 14 to the lock lever 20. As a result, the knob 23 is subjected to a force component tending to lift the knob 23 upwardly along the reference line segment 50 viewing in FIG. 2. However, the application of this force component will not result in disengagement of the knob 23 from the head 15*b* owing to the inclination of the surfaces 25 and 15*c* through the acute angle $\alpha$ (alpha). This arrangement will not incline the cantilever 15*a*, thus keeping the surface 15*c* of the head 15*b* in correct relation with the surface 25 of the knob 23. This means that increasing the amount of compression of the elastic cap 17 will not increase the possibility of accidental disengagement of the head 15*b* from the knob 23.

Figure 3:
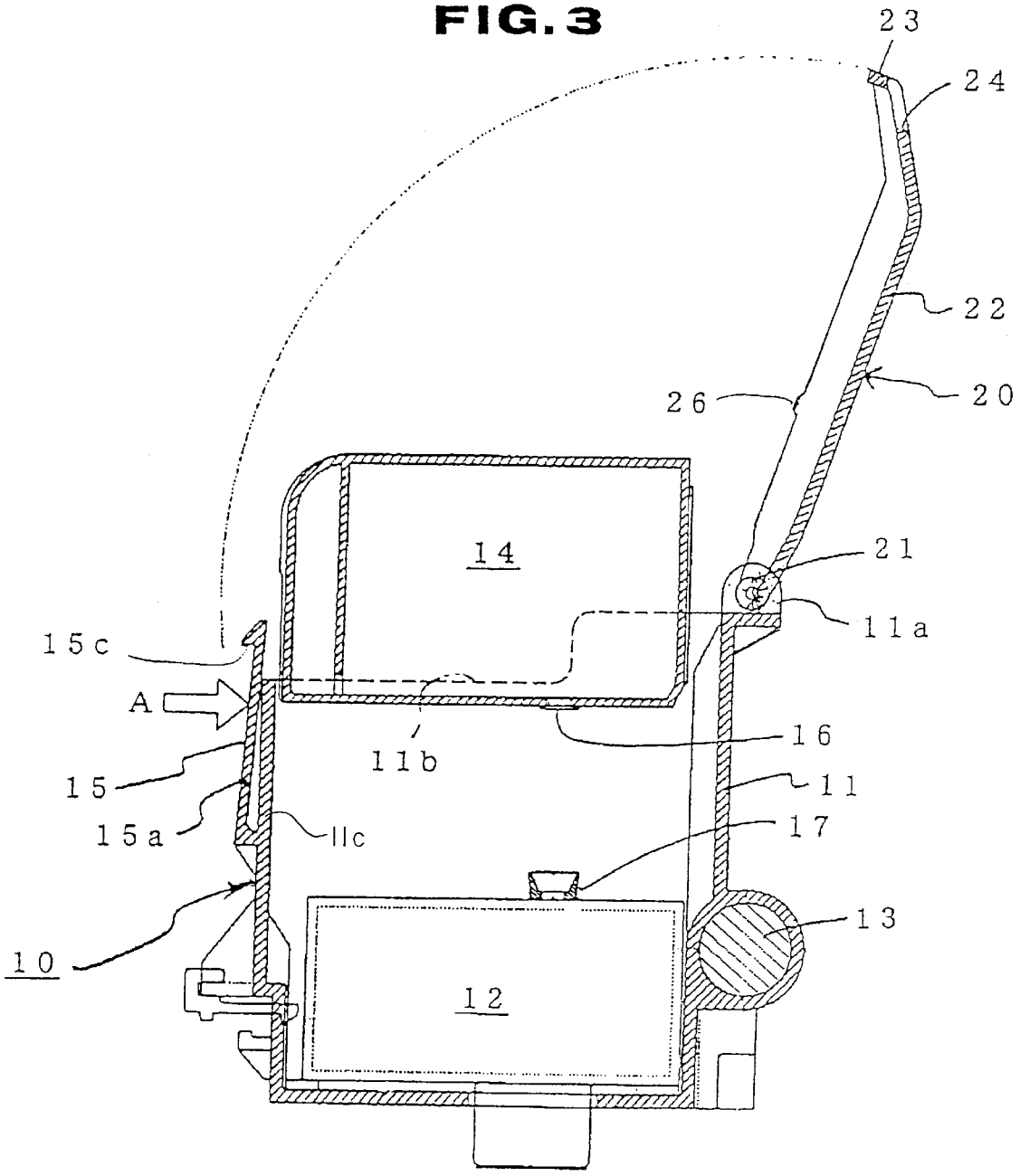
FIG. 3 is a similar view to FIG. 1, showing the carriage with a lock lever raised or opened to an unlocking position.
Figure 4:
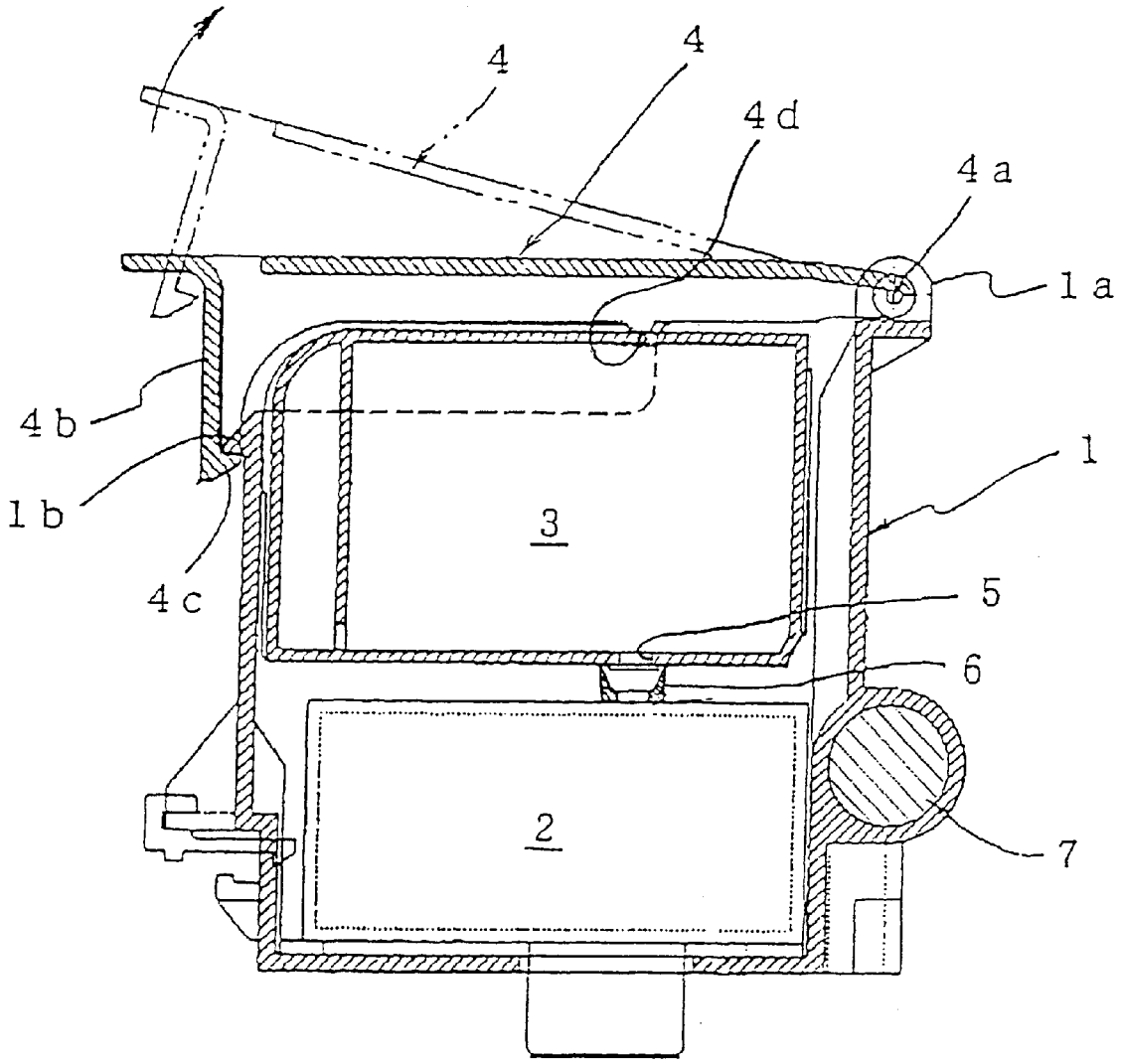
FIG. 4 PRIOR ART
FIG. 4 is a similar view to FIG. 1, showing the less preferred example of the carriage discussed before.

The cartridge 14 may be removed from the carriage 10 after releasing the cartridge 14 from its locked position (see FIG. 1) by opening the lock lever 20 to the position as shown in FIG. 3.

In FIG. 1 or 2, manually pressing the hook 15 in a direction as indicated by an arrow A inclines the cantilever 15*a*. This causes the head 15*b* to move the knob 23 until the window 24 comes into registry with the head 15*b*, allowing the subsequent manual opening movement of the lock lever 20. The elastic cap 17 is allowed to spring back toward its unstressed state to lift the cartridge 14 to a lifted position above the opening 11*b* for ease of removing operation of the cartridge 14.

Manual effort required to incline the cantilever 15*a* in the direction as Indicated by the arrow A may be lowered by increasing the length of the cantilever within the range permitted upon designing the carriage,

What is claimed is:

1. A carriage for an ink cartridge as a source of supply of ink to an ink-jet printhead for an ink-jet printer, comprising:

a case for the ink cartridge;

a lock lever having one end portion pivoted to said case and an opposite end portion; and a snap hook fixed to an external surface of said case, by a cantilever, for engagement with said lock lever at said opposite end portion, said cantilever having a portion extending substantially parallel to said external surface of said case thereby providing a space between said cantilever and said external surface of said case.

2. A carriage as claimed in claim 1, wherein said lock lever is provided with a protrusion at an intermediate portion between said one and opposite end portions for engagement with the ink cartridge.

3. A carriage as claimed in claim 2, wherein said opposite end portion of said lock lever is recessed for allowing said hook to snap back toward an unstressed position thereof.

4. A carriage as claimed in claim 2, wherein said opposite end portion of said lock lever includes a window for allowing said hook to snap back toward an unstressed position thereof.

5. A carriage for an ink cartridge as a source of supply of ink to an ink-jet printhead for an ink-jet printer, comprising:

a case for the ink cartridge;

a lock lever having one end portion pivoted to said case and an opposite end portion; and a snap hook fixed to an external surface of said case for engagement with said lock lever at said opposite end portion, said snap hook having a portion extending substantially parallel to said external surface of said case providing a space there between, wherein said hook includes a head, and wherein said hook is elastically displaced by said lock lever and allowed to snap back toward an unstressed position thereof to put said head into engagement with said opposite end portion of said lock lever.

6. A carriage as claimed in claim 5, wherein, with said head being in engagement with said opposite end portion of said lock lever, said hook is inclined manually to disengage said head from said opposite end portion of said lock lever.

7. A carriage as claimed in claim 6, wherein said hook includes a cantilever having one end fixed to said case and supporting said head.

8. A carriage as claimed in claim 7, wherein said case has a sidewall.

9. A carriage as claimed in claim 1, wherein said lock lever has a knob at said opposite end portion, said knob having a predetermined surface, and wherein said hook includes a head formed with a mating surface for engagement with said predetermined surface.

10. A carriage as claimed in claim 9, wherein said cantilever supports said head.

11. A carriage as claimed in claim 10, wherein said opposite end portion of said lock lever includes a window that defines said predetermined surface of said knob, and wherein said window permits insertion of said head to bring said mating surface into engagement with said predetermined surface to allow said cantilever to snap back toward an unstressed position thereof.

12. A carriage for an ink cartridge as a source of supply of ink to an ink-jet printhead for an ink-jet printer, comprising:

a case for the ink cartridge;

a lock lever having one end portion pivoted to said case and an opposite end portion; and a snap hook fixed to said case for engagement with said lock lever at said opposite end portion, wherein said lock lever has a knob at said opposite end portion, said knob having a predetermined surface, and wherein said hook includes a head formed with a mating surface for engagement with said predetermined surface, wherein said hook includes a cantilever that has one end portion fixed to said case and supports said head, wherein said opposite end portion of said lock lever includes a window that defines said predetermined surface of said knob, and wherein said window permits insertion of said head to bring said mating surface into engagement with said predetermined surface to allow said cantilever to snap back toward an unstressed position thereof, and wherein said predetermined surface is inclined with respect to a reference line segment that is tangential to a point on a path of rotation of said knob.

13. A carriage as claimed in claim 12, wherein said predetermined surface is inclined at an angle of approximately 75 degrees.

14. A carriage for an ink cartridge as a source of supply of ink to an ink-jet printhead for an ink-jet printer, comprising:

a case for the ink cartridge;

a lock lever having one end portion pivoted to said case and an opposite end portion;

an opening within a surface of said lock lever at said opposite end portion; and a snap hook fixed to an external surface of said case, by a cantilever, said cantilever having a portion extending substantially parallel to said external surface of said case, thereby providing a space between said cantilever and said external surface of said case, for engagement with said opening at said opposite end portion.

15. A carriage for an ink cartridge as a source of supply of ink to an ink-jet printhead for an ink-jet printer, comprising:

a case for the ink cartridge;

a snap hook fixed to said case;

a head positioned on said snap hook, said head formed with a mating surface; and a lock lever including an end portion pivoted to said case and an opposite end portion, said lock lever having a predetermined surface for engaging with said mating surface of said head, wherein said predetermined surface is inclined with respect to a reference line segment that is tangential to a point on a path of rotation of said lock lever.

16. A carriage as claimed in claim 5, wherein said lock lever is provided with a protrusion at an intermediate portion between said one and opposite end portions for engagement with the ink cartridge.

17. A carriage as claimed in claim 15, wherein said predetermined surface is oblique with respect to said reference line segment.

18. An ink cartridge carriage, comprising:

a case having a bottom;

an ink-jet printhead for an ink-jet printer, said ink-jet printhead being mounted to said bottom of said case;

an ink cartridge that contains ink to be supplied to said ink-jet printhead and has an ink supply port, said ink cartridge being removably inserted into said case with said ink supply port facing said ink-jet printhead;

an elastic cap of elastic material arranged on said ink-jet printhead at a position opposed to said ink supply port;

a lock lever having one end portion pivoted to said case and an opposite end portion, said lock lever being provided with a protrusion at an intermediate portion between said one end and opposite end portions in engagement with said ink cartridge;

a snap hook fixed to an external surface of said case, by a cantilever, said cantilever having a portion extending substantially parallel to said external surface of said case thereby providing a space between said cantilever and said external surface of said case, a head positioned on said snap hook, said head being formed with a mating surface;

said lock lever having a knob formed with a predetermined surface at said opposite end portion thereof in engagement with said mating surface of said head, said protrusion being pressed against said ink cartridge to cause elastic compression of said elastic cap, thereby to cause the reaction due to the elastic compression of said elastic cap to act through said ink cartridge and said lock lever to lift said knob along a reference line segment, said predetermined surface of said knob and said mating surface of said head being inclined with respect to said reference line segment such that the lift of said knob causes said predetermined surface to firmly engage with said mating surface.

* * * * *